United States Patent [19]

McElroy

[11] 4,209,729

[45] Jun. 24, 1980

[54] ON CHIP VACUUM FLUORESCENT DISPLAY DRIVE

[75] Inventor: David J. McElroy, Houston, Tex.

[73] Assignee: Texas Instruments Incorporated, Dallas, Tex.

[21] Appl. No.: 918,292

[22] Filed: Jun. 21, 1978

[51] Int. Cl.[2] ..... H05B 43/00

[52] U.S. Cl. ..... 315/169.1; 315/84.6; 315/97; 315/105

[58] Field of Search ..... 315/169 R, 169 TV, 94, 315/95, 97, 105, 106, 84.6, 169.1; 340/324 M

[56] References Cited

U.S. PATENT DOCUMENTS 3,553,525 1/1971 McGuirk ..... 315/95

*Primary Examiner*—Eugene R. LaRoche

*Attorney, Agent, or Firm*—William K. McCord; Stephen S. Sadacca; Mel Sharp

[57] ABSTRACT

An improved arrangement for providing cathode heating current in a visual display wherein pulses of heating current are sequentially applied at brief intervals, the magnitude of the current and the intervals being coordinated with the cathode thermal inertia so as to maintain cathode temperature within an operative range during the off periods, and wherein potentials for activating the display are applied during such off periods.

6 Claims, 3 Drawing Figures

ON CHIP VACUUM FLUORESCENT DISPLAY DRIVE

This invention relates to alpha numeric displays and more particularly to such displays containing elements which are intentionally thermally heated.

Displays of the foregoing type are known in the art, illustrative of which are the well known vacuum fluorescent displays. However, such displays have heretofore required an uninterrupted source of electrical current for providing requisite cathodic heating, and such sources of current have typically included filament transformers.

Filament transformers themselves tend to be heavy,- bulky and producers of unwanted heat. In addition, they represent significant elements of expense which it is desirable to reduce or eliminate. Accordingly, there has been a continuing search for ways to provide requisite thermal heating by other means which do not include transformers or the like.

It is one general object of this invention to improve displays of the aforementioned type.

It is another object of the invention to reduce cost and size of associated circuitry and to simplify manufacture and assembly.

Accordingly, in accordance with one feature of the invention, a transformerless source of heating current is provided for rapid repetitive connection and disconnection to the cathode of the display elements, thereby providing desirable flexibility for cooperative coordination with other potentials.

In accordance with another feature of the invention, a source of display activating potential is disposed in cooperative association with the source of heating current and is repetitively connected to the display.

In accordance with yet another feature of the invention, circuit switching means are advantageously employed to coordinate the application of heating current and display activating voltage so as to provide heating current when display activating voltage is removed and vice-versa.

In accordance with still another feature of the invention, the switching circuits and the display activating voltage circuits are embodied within a single MOS semiconductor chip, thereby simplifying manufacture, reducing cost and aiding assembly.

These and other objects and features of the invention will be apparent from the following detailed description by way of reference to the drawing in which.

Figure 1:
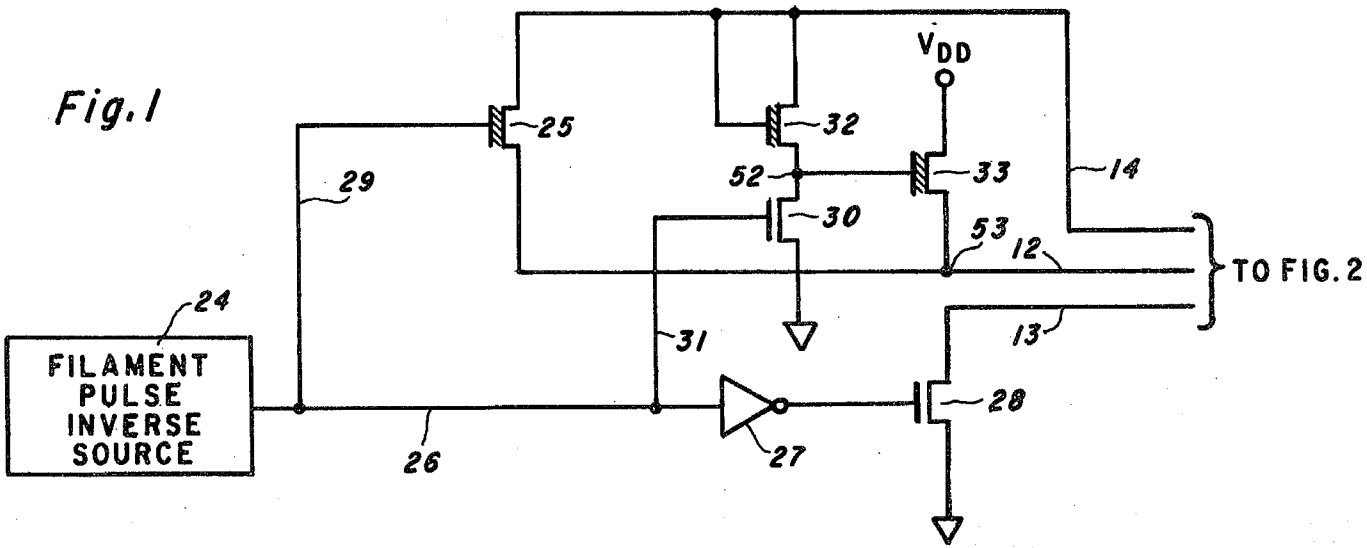
FIG. 1 is a composite block and schematic diagram depicting a portion of the inventive circuitry hereof.
Figure 3:
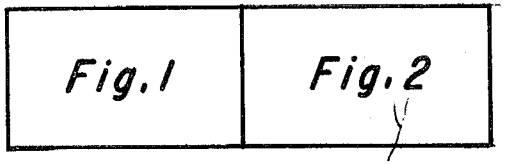
FIG. 3 is a diagram depicting the way in which FIGS. 1 and 2 should be disposed so as to display the overall diagram.
Figure 2:
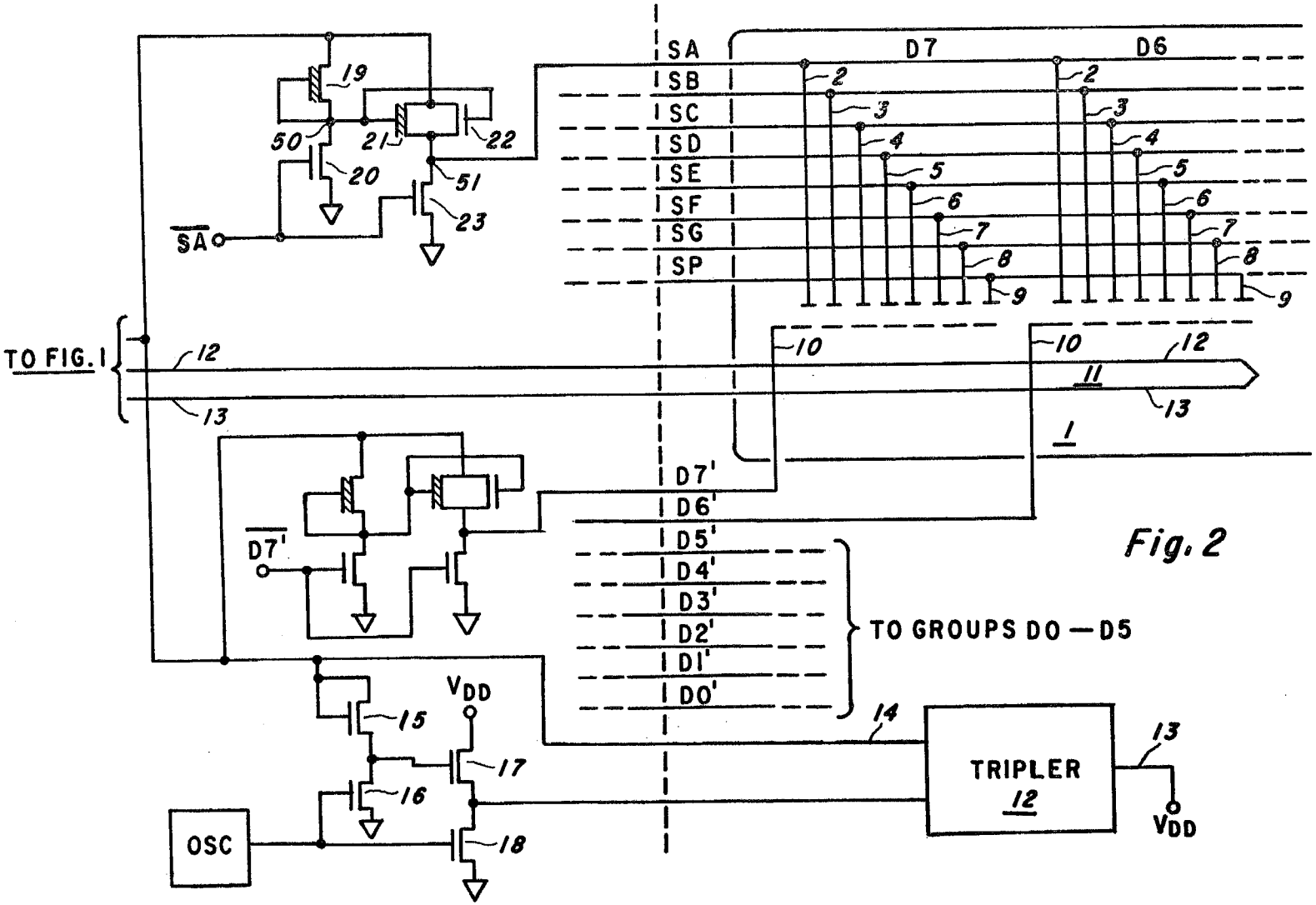
FIG. 2 is another composite block and schematic diagram depicting another portion of the inventive circuitry hereof.

Now turning to FIGS. 1 and 2, it will be observed that there is therein depicted a vacuum fluorescent display generally designated by the numeral 1. Although within the vacuum fluorescent display there may be a substantial number of element groups, only two such groups are shown in FIG. 2, six other groups being suggested by the designators D0 through D5. The six groups D0–D5 are identical to groups D6 and D7 and are therefore not individually shown in order to aid in the clarity and simplicity of description.

Further reference to the vacuum display 1 reveals that each group therein comprises 8 individual segments 2–9. Associated with each group is grid element 10. Also included is common filament element 11 comprising conductors 12 and 13. Further included (but not shown for sake of clarity and simplicity) are groups of elements respectively related to conductors D5', D4', D3', D2', D1' and D0'.

It will be helpful to a more complete understanding of the display elements hereof to make reference to U.S. Pat. No. 4,014,013 and especially FIG. 1C of that patent which depicts the 7 individual elements which make up the parts of each digit symbol. In that figure, designators SA–SP are employed to illustrate connection to the elements, and for purposes of reference, similar symbols are employed for the conductors exiting from vacuum fluorescent display 1 of the herein invention. Accordingly, as will be evident from reference to the hereinabove identified patent, leads SA–SG are connected individually to the 7 segments which are disposed to represent any digit 0–9, and SP is connected to a segment which, when activated, displays a decimal point.

While the display of the herein referenced patent employs light emitting diodes, the principle of selective application of voltages to segments thereof and the activation of individual digits is similar. However, certain significant differences occur due to the fact that the vacuum fluorescent display herein described includes grid members 10 (which each enable its associated group of elements) as well as common heated cathode 11.

Further reference to FIGS. 1 and 2 reveals that circuitry is depicted for element SA and not repeated for element SB–ST, as such circuitry will be identical to that shown for SA. Similarly, circuitry for controlling the grid is depicted for group D7 and is not repeated for groups D0–D6, as such circuitry is identical to that depicted for group D7.

Further reference to FIG. 2 reveals tripler circuits 12 to which supply voltage $V_{dd}$ is conducted over conductor 13. Tripler circuits 12 may be any of those conventional circuits which employ voltage multiplication through the advantageous use of non-linear element-capacitor interaction. Transistor 15–18 comprise the on-chip drive circuitry which combined with off-chip diodes and capacitors (not shown) comprise the voltage tripler. Such circuits are well known to those skilled in the art.

If $V_{dd}$ is equal to approximately minus 9 volts, then the output of tripler 12 will approximate −25 volts. This is conducted via conductor 14 to various of the circuits as shown.

Before proceeding further with the description of the cathode heating circuits, reference is made to the driving circuits for potential SA and D7'. Reference to FIG. 2 reveals these circuits to be similar, and a brief explanation of their operation will now be given.

At the outset, it will be recognized that inputs to these circuits are $\overline{SA}$ and $\overline{D7}$. By this is meant that these input potentials are the inverse of those which it is desired to apply to conductors SA and D7'.

When it is desired to produce an activating potential on segment conductor SA, the inverse signal is applied to input terminal $\overline{SA}$ by connecting it to ground. Transistors 20 and 23 are thereby turned off allowing node 50 to conduct to −25 V potential thereby causing transistors 21 and 22 to conduct and causing SA to also conduct to −25 V. At this negative-most potential, SA is not energized and will not be illuminated regardless of the condition of other signals. When $\overline{SA}$ goes to $V_{dd}$ level, then transistors 20 and 23 are turned on, SA is therefore at ground potential; this being the most positive voltage in the system and SA will be illuminated, depending on cathode and grid voltages.

When the filament is receiving heating current, the filament pulse inverse source 24 produces a ground potential which when conducted to the gate of transistor 25 over conductor 29 is effective to cause transistor 25 to become non-conducting because the gate is more positive than the source by 9 V and is therefore "pinched-off." At the same time , it is conducted via conductor 31 to the gate of transistor 30 causing it to become nonconducting. This allows 52 to increase to a large negative voltage turning on transistor 33 which applies $V_{dd}$, or $-9$ volts, to one side of the cathode filament. The inverter 27 applies a negative voltage to transistor 28 causing it to become conductive, thereby supplying a return path for the cathode filament current. When the filament is not being heated, source 24 supplies a negative 25 volts to lines 26, 31, and 29 which causes transistor 30 to conduct which pulls node 52 to ground, thereby causing transistor 33 to cut off. Node 53 is thus allowed to go to a larger negative voltage to which it is pulled by transistor 25 which is turned on via line 29. Transistor 28 is turned off by inverter 27 and line 13 is thus floating or high impedance. Now the condition of the filament is such that one end is high impedance, line 13, and the other end, node 53 and line 12, has been caused to be at $-25$ volts, this being the negative-most potential in the system and the appropriate one for normal vacuum-tube operation.

It will now be evident to those skilled in the art that through the implementation of the features of the herein-disclosed inventions, displayed circuitry can be simplified, manufacture facilitated, and costs reduced.

Although the above-described example illustrates the inventions as involving vacuum fluorescent displays, it will be evident to those skilled in the art that the principles are applicable also to other devices.

The words and expressions employed are intended as terms of description and not of limitation, and there is no intention in the use thereof excluding any equivalents, but on the contrary, it is intended to include any and all equivalents, adaptations and modifications that may be employed without departing from the spirit and scope of the inventions.

What is claimed is:

1. A display system comprising:

(a) a plurality of displayable characters each being comprised of a respective set of activatable segment electrodes;

(b) an electron-emissive member common to all of said displayable characters;

(c) a plurality of anode electrodes in cooperative association with said electron-emissive member, each of said anode electrodes being in cooperative association with a respective one of said characters;

(d) electrical power supply means for supplying electrical current to said electron-emissive member to electrically heat said member and for providing a predetermined voltage; and (e) means for alternately enabling and disabling the supply of heating current to said electron-emissive member at a predetermined rate in dependence upon the thermal inertia of said member so as to maintain the temperature thereof within a predetermined range and for selectively applying said predetermined voltage between said electron-emissive member and selected ones of said anode electrodes during periods when said current supply to said electron-emissive member is disabled, whereby a visual display is produced at selected character positions associated with said selected ones of said anode electrodes.

2. Apparatus according to claim 1 wherein said rate is selected for coordination with the thermal inertia of said member so as to maintain the temperature of said member within the predetermined range in which said member is effectively electron emissive.

3. Apparatus according to claim 2 wherein said visual display is vacuum florescent.

4. Apparatus according to claim 2 in which said rate is selected to yield a duty cycle of approximately $\frac{1}{8}$th.

5. Apparatus according to claim 1 wherein said visual display is vacuum fluorescent.

6. Apparatus according to claim 1 wherein said source of predetermined voltage includes a voltage tripler.

* * * * *